US006481317B1

(12) United States Patent
Reyes

(10) Patent No.: US 6,481,317 B1
(45) Date of Patent: Nov. 19, 2002

(54) ADJUSTABLE CROWFOOT DEVICE

(76) Inventor: Louis Reyes, 2317 SE. Maryland, Topeka, KS (US) 66605

( * ) Notice: Subject to any disclaimer, the term of this patent is extended or adjusted under 35 U.S.C. 154(b) by 0 days.

(21) Appl. No.: 09/435,522

(22) Filed: Nov. 8, 1999

Related U.S. Application Data

(60) Provisional application No. 60/107,669, filed on Nov. 9, 1998.

(51) Int. Cl.[7] ..... B25B 13/22

(52) U.S. Cl. ..... 81/133; 81/165; 81/129

(58) Field of Search ..... 81/165, 133, 129.5, 81/129

(56) References Cited

U.S. PATENT DOCUMENTS 2,483,917 A * 10/1949 Maselter ..... 81/133
3,171,307 A * 3/1965 Jamal ..... 81/133
4,942,790 A * 7/1990 Wang ..... 81/133
5,154,103 A * 10/1992 Lewis, Jr. ..... 81/165
5,209,144 A * 5/1993 Guoji ..... 81/165
6,125,724 A * 10/2000 Murphy et al. ..... 81/133
6,128,980 A * 10/2000 Hu ..... 81/170

* cited by examiner

*Primary Examiner*—Lee D. Wilson
(74) *Attorney, Agent, or Firm*—Bruce J. Clark

(57) ABSTRACT

An adjustable crowfoot device removably attachable to an extension device, for gripping and either loosening or tightening an object in response to a turning motion of the extension device, and having a fixed claw member with a pinion receiving hole, an adjustable claw member, rack and pinion for slidably connecting the adjustable claw member to the fixed claw member where the pinion is rotatably connected within the pinion receiving hole and where the adjustable claw member has a rack having teeth connected to the pinion such that the teeth extend away from the flat surface between the two flat surfaces of the claw so as to provide a continuity of mating area.

4 Claims, 4 Drawing Sheets

ADJUSTABLE CROWFOOT DEVICE

This application claims the benefit of U.S. Provisional Application No.60/107,669 filed Nov. 9, 1998.

BACKGROUND OF INVENTION

This invention relates to the field of hand tools, in particular a crowfoot. A crowfoot is a descriptive name used for a fixed-jaw, offset tool for tightening and loosening nuts, bolts and fittings in tight places. It is utilized by expert craftsmen to reach into inaccessible regions of heavy equipment and machinery, for example, where hex fittings, nuts and bolts, etc. are both difficult to reach and difficult to maneuver a tool around. In these situations, access is typically limited to utilizing an elongated rigid handle member (extension), to which there is removably attached a variation of sizes of fixed-jaw crowfeet. The craftsman simply selects out of his or her toolbox the appropriate metric or standard-sized crowfoot for the anticipated need, attaches it to the end of the elongated handle, inserts the handle and crowfoot attachment deep down into the machinery where needed, and twists and turns as necessary to loosen or tighten the respective nut, bolt or fitting.

This has several disadvantages and deficiencies. In particular, it requires an unusually high and burdensome number of tools inasmuch as a separate crowfoot is needed for each size of nut, bolt, or fitting available, in both metric and standard sizes. If one is working on an engine locomotive, an airplane engine or heavy sophisticated machinery of any kind, in house or in the field, there is a need for a single adjustable crowfoot that is not only relatively compact so as to fit in tight places while retaining its adjustable features, but is also easy to maneuver in tight places so that it is not only easy to turn while maximizing the force needed, but is somewhat self-adjusting so as to easily and automatically clamp and tighten onto the respective nut or bolt head in response to the operator's turn, when the operator is sometimes several feet away from the respective nut or bolt. The instant invention not only achieves these objectives but is particularly well suited for those nuts, bolts and fittings of a hex or square variety.

A further problem relates to the need for the adjustable crowfoot to be removably attachable, yet sufficiently secured so as to essentially eliminate the risk of disengagement during use on heavy machinery. This is significant because the invention is particularly suited for the high level craft work on such things as engines, hydraulics, and other sophisticated machinery where it is not only important but in some cases governmentally required that the only tools that can be used are the disengagable type. Tools dropped in such sophisticated equipment cannot often be recovered without fully disassembling the equipment, an option that is not commonly or practically available on such equipment. Thus, is often the requirement for both practical and legal reasons, that all tools be pre-approved as the non-disengageable type.

Consequently, it is an object of the present invention not only to provide an adjustable crowfoot to substantially reduce the number of tools needed, but to provide such a crowfoot that is compact, maneuverable, easy and effective to use, relatively inexpensive to make, and is also reliable and utilizes the ability to lock and release on the respective fitting in direct response to the user, and further is non-disengagable. It is a further object that it be capable of accessing tight and hard to reach places, at a long distance utilizing an elongated rigid handle (extension) and that the crowfoot be adjustable from a distance.

The closest known device is disclosed in Schultz, U.S. Pat. No. 4,802,389. Schultz discloses and adjustable wrench that can be utilized with an extension as an adjustable crowfoot, however, Schultz's device would not work to meet the objectives of the present invention inasmuch as the adjustable jaw member in Schultz is situated so as to prevent or hinder the tool's accessing of the respective bolt, nut or fitting. To utilize the device in Schultz, one must approach the subject nut or bolt from the side. The present invention not only allows for a direct, hands-on approach to the bolt by the claws, but is far more precise; moreover, because the teeth of the rack in the instant invention are disposed away from the gripping area (just opposite to that shown in Schultz), the instant device allows for a precise, hex-shaped gripping area, the type of precision necessary to maximize the torque and gripping in extended and difficult to reach places. In short, the invention in Schultz would not work to achieve most of the objectives in the present invention.

Other objects and features of the invention and the manner in which the invention achieves its purpose will be appreciated from the foregoing and the following description and the accompanying drawings which exemplify the invention, it being understood that changes may be made in the specific method and apparatus disclosed herein without departing from the essentials of the invention set forth in the appended claims.

DESCRIPTION OF THE PREFERRED EMBODIMENT

Figure 1:
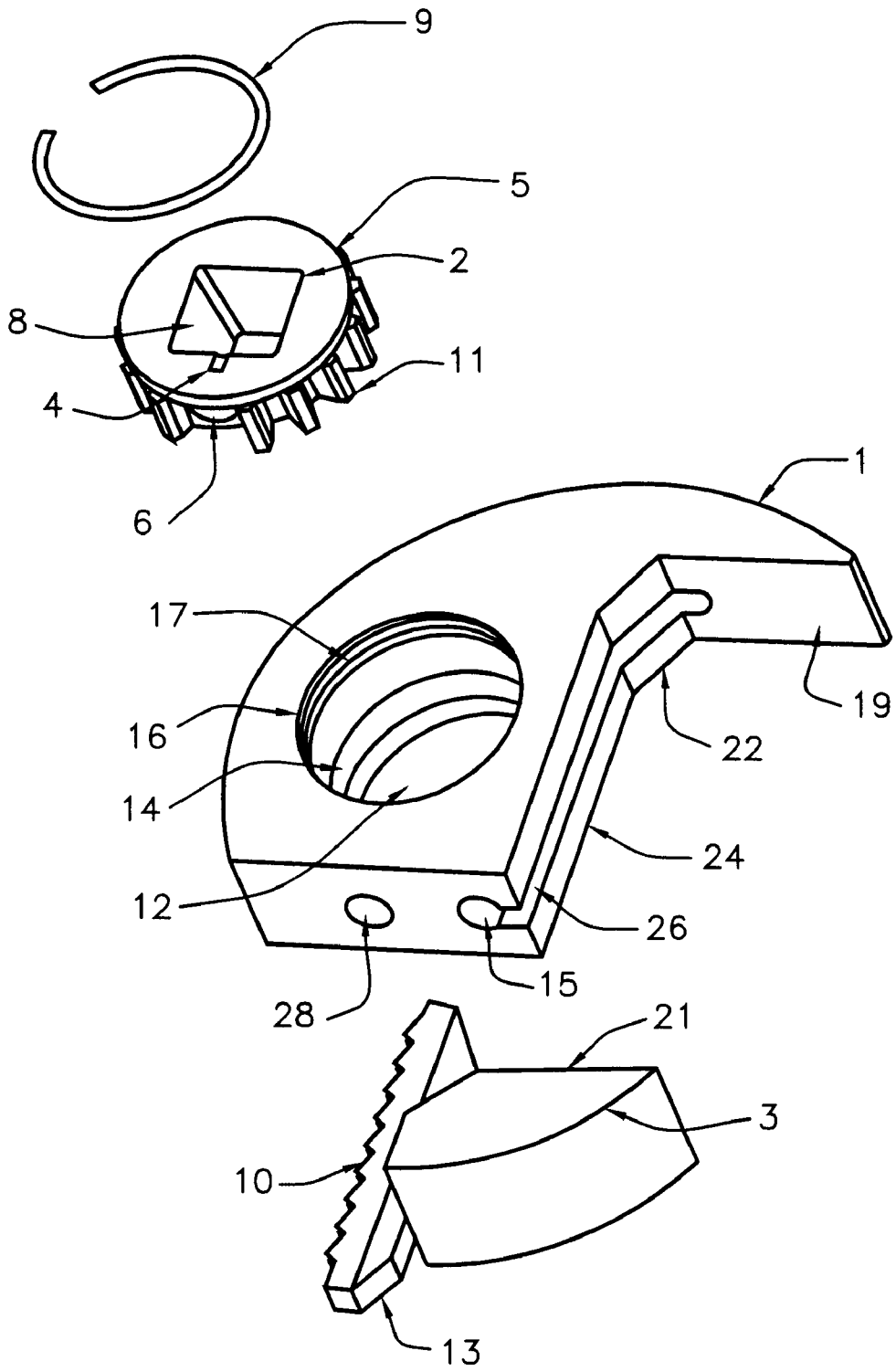
FIG. 1 is an exploded view of the preferred mode of the invention.

The invention in the preferred mode is shown in FIG. 1 in an exploded view. The fixed claw, 1, has planar face 19, adjacent an angled surface 22, which surface corresponds to the angles on a hex nut, bolt or fitting. Said angled surface 22 is immediately adjacent to flat planar surface 24, which surface 24 is perpendicular to fixed claw face 19. Open channel 26 receives the rack 13 and is further open to a larger track-receiving Channel 15. Channels 15 and 26 extends through the fixed-claw member 1. Adjustable claw member 23 has flat planar surface 21, whose planar surface is parallel to that of surface 19 when the rack 13 to which the adjustable claw 23 is attached is inserted into the channels 15 and 26.

Channel 15 is further open to the interior of the gear-receiving hole, 16, so that the teeth 11 of the gear 5 interengage with corresponding teeth 10 of rack 13. The gear 5 described in more detail further herein, rests against inner surface 14 of the fix-claw member 1. The surface 14 is made sufficiently large to retain the gear 5 and so as to allow access to the extension-receiving cavity 8 through larger hole 12. The extension-receiving cavity 8 extends through the gear 5 so as to allow access to it from either side of the gear 5. Gear 5 rotatably sits inside the gear-receiving hole 16 and is rotatably secured in said hole by wire retainer 9 which wire retainer is of sufficient size to fit snugly around the gear 5 as will be seen further in FIG. 5, yet extend into the recessed gap 17 in gear-receiving hole 16. Gear 5 is shown having at least one missing tooth (and only one tooth in a preferred mode) to allow hole 6, which corresponds to a slot or other indicia 4 on the outside face 2 of the gear, the purpose of which is to gain access to the extension cavity 8 when the slot or indicia is matched. Access is achieved utilizing a pin inserted through hole 28, then through hole 6 when the gear is aligned, so as to release the locking pin on the extension which will more clearly be seen in FIG. 4.

Figure 2:
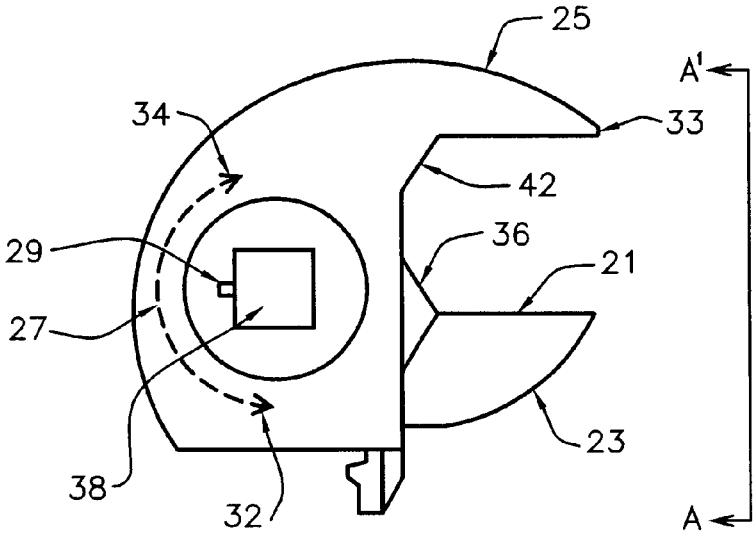
FIG. 2 is a front view of the invention.

In FIG. 2, the locking pin indicator 29 which corresponds to the locking pin indicator 4 in FIG. 1, is shown in a position with the fixed and adjustable jaw substantially open. In the preferred mode, when this indicator is rotated to position 32, the jaws will be essentially closed and it is in this position that the holes 6 and 15 (in FIG. 1) align so as to allow access to the extension cavity 8. Moreover, when the indicator, 29, is approximately in the position shown as 34 in FIG. 2, the jaws 23 and 25 essentially open in their maximum position.

Also shown in FIG. 2 is the hex-surface 36 which is part of the adjustable claw 23 and is at an angle with relation to the adjustable claw gripping face 21 so as to correspond with the hex face 42 which together provide the approximate angles for receiving and gripping typical hex-head arrangements. Thus it can be seen that the teeth of the rack are disposed away from the gripping area, the gripping area extends opposite the teeth of the rack and, further, extends away from the extension cavity 38. The continuous, preferably non-circular curve 25 of the fixed-claw portion, narrows to the distal end 33 to allow for a compact device that is precise, able to reach under and into hard-to-access places, around obstacles and still obtain a precise fit around hex and square heads and fittings and further maintain maximum torque.

Figure 3:
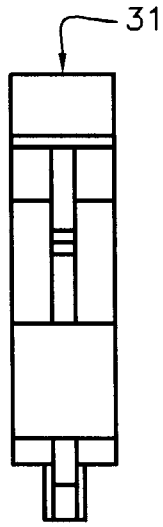
FIG. 3 is a side view of the invention looking into the direction A/A' of FIG. 2.

FIG. 3 is a side view of FIG. 2. The end 31 of the channels (15 and 26 in FIG. 1) is seen in the exterior of the fixed-claw portion.

Figure 4:
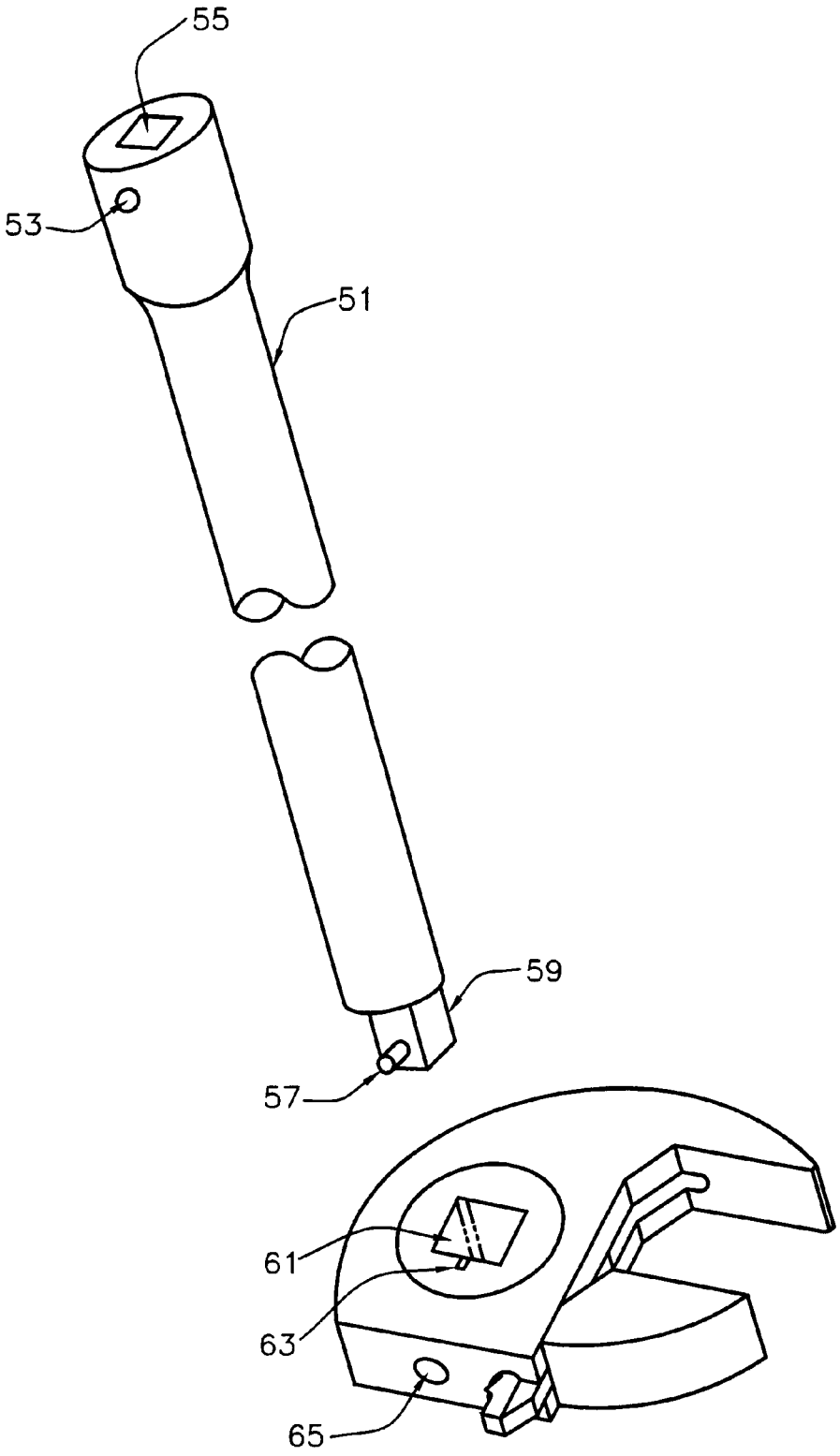
FIG. 4 is a perspective view of the invention in its completed form, and showing an extension.

FIG. 4 discloses and extension 51 having near its end 59 a spring-loaded pin 57 such that when pressed inwardly, the pin 57 allows the end 59 to be inserted into the extension cavity 61. This pin, when extended, corresponds to the hole 6 in FIG. 1 (91 in FIG. 6). As discussed previously, and as shown in FIG. 4, with the indicator 63 aligned with the hole 65 an external pin inserted through the hole 65 can reach to the pin 57 in order to depress the pin 57 in order to remove the extension 51. It is not uncommon to use a number of lengths of extensions, end to end, such that the end of the previous extension can fit into the hole 55 utilizing pin-receiving hole 53 all in order to reach tight, far-off places in the subject equipment being serviced. The extensions can sometimes reach as far as three feet or more in length.

Figure 5:
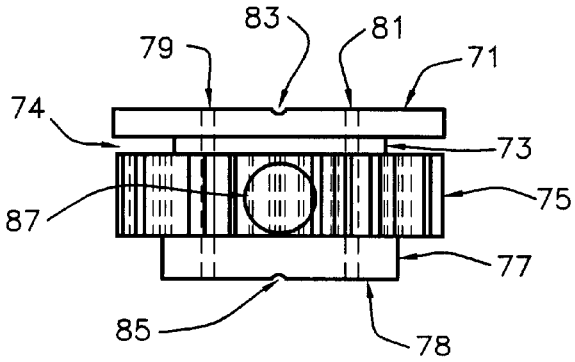
FIG. 5 is a side view of the pinion gear.

FIG. 5 shows a side view of the gear. It has a first outer circular surface 71 having a diameter that essentially matches the inner diameter of the gear-receiving opening 16 and has an adjacent smaller circular portion 73 with a smaller diameter which is then adjacent to the gear teeth portion 75, having a diameter (from outside of gear teeth) essentially the same as 71. The gap 74 is created to allow for receiving of the clip retaining means 9 in FIG. 1. Adjacent to the gear teeth portion 75 is the second and outer surface of the gear member comprising a cylindrical hub 77 having a bottom surface 78 parallel to 71. This hub has a diameter in the preferred mode slightly larger than 73, but less than the diameters of section 71 and 75. The extension-receiving cavity is shown by channel defining lines 79 and 81 as extending through the gear member from surface 71 to hub surface 78. Hole-indicating notches 83 and 85 are aligned vertically with the hole 87 to mark the location of said extension pin receiving hole 87.

Figure 6:
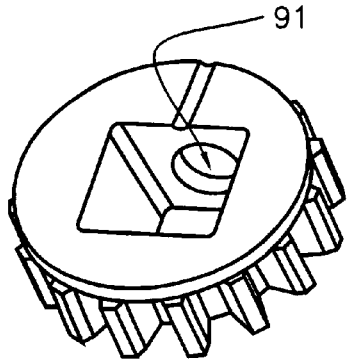
FIG. 6 is a perspective view of the pinion gear.
Figure 7:
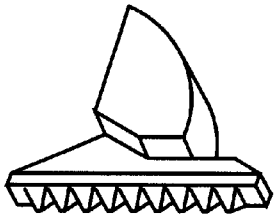
FIG. 7 is a perspective view of the rack.
Figure 8:
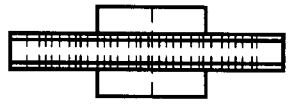
FIG. 8 is a bottom view of the rack in FIG. 7.
Figure 9:
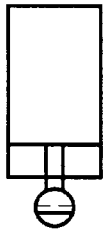
FIG. 9 is an end view of the rack shown in FIG. 7.
Figure 10:
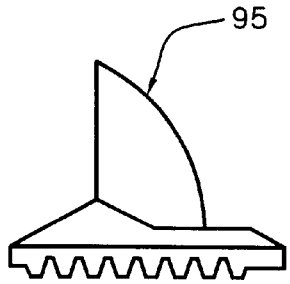
FIG. 10 is a side view of the rack.

FIG. 6 shows a reverse perspective view of the gear showing the hub side up as well as the interior of the extension pin receiving hole 91. It should be noted that the extension pin receiving hole 91 is also well-suited to fit and accept not only an extension having a pin retainer as described previously, but also a spring-loaded ball retainer. However, a spring-loaded ball retainer is not usually used in hard to reach places inasmuch as it is not sufficiently secure to assure the crowfoot does not disengage.

The adjustable claw is shown in more detail in FIGS. 7, 8, 9, and 10 where it can be seen that the specific curve 95 as described allow for relatively easy access in limited areas, and further allows for easy turning of the device.

In use, as it has been described, one simply inserts the extension having spring-loaded pin retaining means into the extension-receiving cavity of the device so as to engage the pin-receiving hole in the gear member, thus locking the extension in place. If additional extensions are needed to reach further into the equipment, one can simply add extensions end to end. The crowfoot is brought forward to approach the subject nut, bolt or fitting deep within the equipment, so as to rest the adjustable claw face against the subject bolt, then as the device is turned to tighten it will be seen that the turning of the extension by the user causes an immediate turn of the body of the tool (the fixed claw toward the adjustable claw) and continued movement causes natural tightening of the two claws onto the bolt as further turning causes the bolt to turn in the desired direction. To unscrew the bolt (reversed) one simply removes the crowfoot and reconnects it from the other side.

Thus it can be seen is what has been invented is a precise and effective tool designed for and capable of accessing distant and difficult to reach places in sophisticated machinery while maintaining not only the precision during adjustability, but maintaining efficient and maximum transfer of the torque applied to the extension. Moreover this has been done with a device that is relatively compact, inexpensive to make, universal, and reliable in use.

While there have been shown and described particular embodiments of the invention, it will be obvious to those skilled in the art that changes and modifications may be made without departing from the invention or its equivalent, and, therefore, it is intended by the appended claims to cover all such changes and modifications as fall within the true spirit and scope of the invention.

I claim:

1. An adjustable crowfoot device removably attachable to extension means, for gripping and either loosening or tightening an object in response to a turning motion of the extension means, comprised of:

a. a rigid main body having an extended portion, said extended portion having a tip end and an essentially flat face between the tip end and the main body, all comprising a fixed claw member;

b. a second flat portion on said fixed claw member essentially perpendicular to the first flat portion, and a first open channel extending adjacent to and open to the second flat portion and extending through the fixed claw member;

c. a second larger channel extending through the fixed claw member adjacent to, and open to, the first open channel member such that the channels combine to receive and slidably retain a racked claw;

d. cylindrical gear means having two sides and a circumference having a plurality of teeth, said gear means rotatably disposed within the fixed claw member so as to allow receiving of an extension means from either side, wherein the gear means has a pin access hole extending from one side to the other for access to a extension receiving hole, and further has a pin access hole extending through the pinion from the pinion perimeter to the extension receiving hole, and wherein the main body of the fixed claw member has a corresponding pin access hole extending from its perimeter to its interior gear receiving hole such that when the two holes are aligned, access is gained to the extension receiving hole so as to allow a pin-type device to be inserted to release any spring loaded extension securing means;

e. a rigid adjustable claw member having a tip end defining one end of an essentially flat face opposing the first flat face, a racked end opposite the tip end such that the racked end has a plurality of equally spaced apart teeth, and spaced in a linear direction perpendicular to the flat face, and such that the rack is slidably retained to the first rigid member via the first and second channels such that the teeth are disposed away from the second flat surface of the first rigid claw member and such that the adjustable claw member slides back and forth generally along the second flat surface in response to a turning of the cylindrical gear;

f. a first and second flat angled surface wherein the first flat angled surface connects the first flat face with the second flat portion, and whereby the second flat angled surface connects the flat face on the adjustable claw with the racked end, all such that the first flat face, the first flat angled surface, the the second flat angled surface, and the adjustable claw flat face, together essentially comprise four sides of a polygon shape during a gripping process.

2. An adjustable crowfoot device removably attachable to extension means, for gripping and either loosening or tightening an object in response to a turning motion of the extension means, comprised of:

a. a rigid fixed claw member having a perimeter and a pinion receiving hole having a recessed gap in the hole;

b. an adjusted rigid claw member c. rack and pinion means for adjustably moving the adjustable claw member in relation to the fixed claw member, wherein the pinion is comprised of an essentially cylindrical member having a pinion perimeter defined by a first outer portion having a first diameter, a second portion attached thereto having a smaller diameter, a third gear teeth portion, creating a gap for receiving clip retaining means, which clip means extend into a corresponding recessed gap in the fixed claw member, and which clip means provides means for rotatably securing the pinion to the fixed claw member as well as providing tension means so as to reduce unintended slippage and rotation of the pinion.

3. The adjustable crowfoot device in claim 2 wherein the pinion means has an extension receiving hole therein, and further has a pin access hole extending through the pinion from the pinion perimeter to the extension receiving hole, and wherein the fixed claw member has a corresponding pin access hole extending from its perimeter to the pinion receiving hole such that when the two pin access holes are aligned, access is gained to the extension receiving hole so as to allow a pin-type device to be inserted to release a spring loaded extension securing means.

4. An adjustable crowfoot device removably attachable to extension means, for gripping and either loosening or tightening an object in response to a turning motion of the extension means, comprised of:

a. a rigid main body having an extended portion, said extended portion having a tip end and an essentially flat face between the tip end and the main body, all comprising a fixed claw member, and wherein said fixed claw member has a perimeter defining its exterior limits, a large portion of which is curvilinear beginning from approximately near the tip of the extended portion and continuing in a direction away from the first flat portion to at least a point near that portion of the main body opposite the second flat portion;

b. a second flat portion on said fixed claw member essentially perpendicular to the first flat portion, and a first open channel extending adjacent to and open to the second flat portion and extending through the fixed claw member;

c. a second larger channel extending through the fixed claw member adjacent to, and open to, the first open channel member such that the channels combine to receive and slidably retain a racked claw;

d. cylindrical gear means having two sides and a circumference having a plurality of teeth, said gear means rotatably disposed within the fixed claw member so as to allow receiving of an extension means from either side, wherein the gear means has a pin access hole extending from one side to the other for access to an extension receiving hole, and further has a pin access hole extending through the pinion from the pinion perimeter to the extension receiving hole, and wherein the main body of the fixed claw member has a corresponding pin access hole extending from its perimeter to its interior gear receiving hole such that when the two holes are aligned, access is gained to the extension receiving hole so as to allow a pin-type device to be inserted to release any spring loaded extension securing means;

e. a rigid adjustable claw member having a tip end defining one end of an essentially flat face opposing the first flat face, a racked end opposite the tip end such that the racked end has a plurality of equally spaced apart teeth, and spaced in a linear direction perpendicular to the flat face, and such that the rack is slidably retained to the first rigid member via the first and second channels such that the teeth are disposed away from the second flat surface of the first rigid claw member and such that the adjustable claw member slides back and forth generally along the second flat surface in response to a turning of the cylindrical gear;

f. a first and second flat angled surface wherein the first flat angled surface connects the first flat face with the second flat portion, and whereby the second flat angled surface connects the flat face on the adjustable claw with the racked end, all such that the first flat face, the first flat angled surface, the the second flat angled surface, and the adjustable claw flat face, together essentially comprise four sides of a polygon shape during a gripping process.

* * * * *